United States Patent [19]

De Blieck

[11] 4,406,078

[45] Sep. 27, 1983

[54] SIGHT RIB FOR FIREARM LEVELING

[76] Inventor: John H. De Blieck, 4707 Rose Hill, Boise, Id. 83705

[21] Appl. No.: 260,890

[22] Filed: May 6, 1981

[51] Int. Cl.[3] ..... F41G 1/02

[52] U.S. Cl. ..... 42/1 S; 89/14 C

[58] Field of Search ..... 42/1 S, 1 SR; 89/14 C; 33/233

[56] References Cited

U.S. PATENT DOCUMENTS

| | | | |
|---|---|---|---|
| 2,916,970 | 12/1959 | Mutter | 89/14 C |
| 3,808,943 | 5/1974 | Kelly | 89/14 C |
| 4,008,538 | 2/1977 | Center | 89/14 C |

*Primary Examiner*—Charles T. Jordan

*Attorney, Agent, or Firm*—Paul F. Horton

[57] ABSTRACT

An improved sight rib for firearm leveling which is attachable to firearm barrels having a top located bore vent, said sight rib including a housing having one or more upwardly extending apertures in fluid communication with the bore vent. The rib preferably includes an expansion chamber in communication with the bore vent from which a plurality of oppositely disposed backwardly and upwardly inclined apertures extend. By use of an appropriate sight rib, a firearm may be fine-tuned to overcome recoil.

6 Claims, 4 Drawing Figures

SIGHT RIB FOR FIREARM LEVELING

BACKGROUND OF THE INVENTION

1. Field of the Invention

This invention relates to firearms in general and to an improved sight rib for firearms, in particular.

2. Description of the Prior Art

Gas porting devices and choke tubes which attach to the muzzle end of firearms for the reduction of recoil have been known in the art for some period of time. Such devices are very effective in accomplishing their designated purpose of leveling the firearms to which they are attached. Typical of such devices are those disclosed by R. M. Cutts, U.S. Pat. No. 2,963,943, and W. A. Center, U.S. Pat. No. 4,008,538. The primary disadvantages of this type of leveler are two fold. The firearms to which they are attachable are ordinarily not provided with threads for attachment and therefore must be machined. Secondly, the attachments extend the length of the barrel which may result in a change of shooting characteristics and inconvenience in carrying and storage. To overcome these disadvantages, vent ports have been incorporated directly into the barrel, usually in the form of a series of upwardly and outwardly extending paired gas ports communicating directly with the bore of the barrel. Such vents weaken the barrel and complicate the problem of maintaining a clean bore, but, more importantly, in that the size, number, and placement of the ports are predetermined and fixed at time of manufacture they cannot be altered practically.

In that the operation of a firearm, particularly regarding stance, holding, and firing, is very much a matter of personal comfort and choice, and, in that ammunition used with a particular firearm may differ from time to time, firearms which cannot be altered as to recoil capabilities meet with general disapproval. Heretofore, sight ribs have not been used for the purpose of reducing recoil.

SUMMARY OF THE INVENTION

The present invention comprises an improved sight rib attachable to firearm barrels having a top located bore vent, the sight rib being provided with one or more upwardly extending ports in communication with the bore vent for reducing recoil. The rib also preferably includes an expansion chamber. A more detailed description of the invention may be found in the appended claims.

It is therefore a primary object of the present invention to provide a device attachable to a firearm which is operable to reduce recoil but does not lengthen the barrel of the firearm. More specifically, it is a primary object of the present invention to provide an improved sight rib operable to reduce recoil.

It is also an object to the present invention to provide anti-recoil capability in a firearm without increasing the number of parts making up the firearm.

It is a further object to the present invention to provide an improved sight rib by which a firearm may be fine-tuned as to the reduction of recoil.

A still further object of the present invention is to provide a firearm leveling device which is esthetically pleasing and which strengthens the barrel.

These and other objects and advantages will become apparent and a more thorough and comprehensive understanding may be had from the following description taken in conjunction with the accompanying drawings forming a part of this specification.

DETAILED DESCRIPTION OF THE INVENTION

Figure 1:
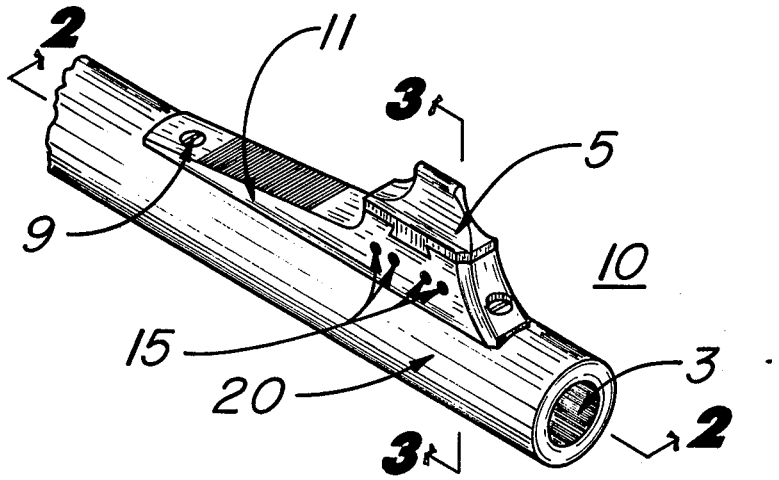
FIG. 1 is a perspective view of one embodiment of the improved sight rib of the present invention shown mounted on a gun barrel.
Figure 2:
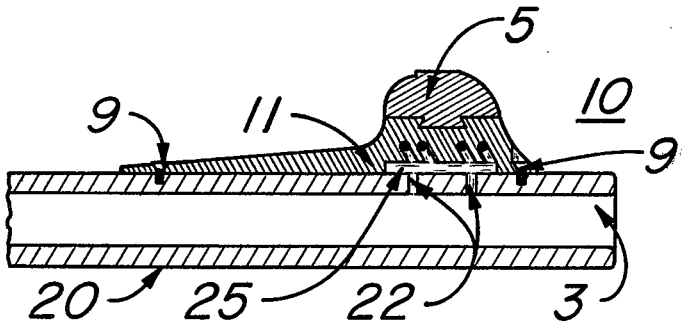
FIG. 2 is a sectional view of the sight of FIG. 1.
Figure 3:
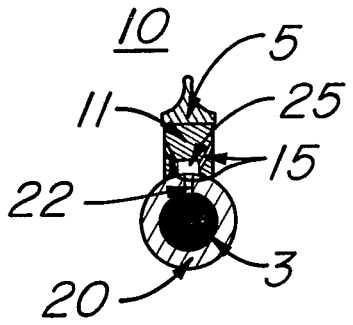
FIG. 3 is a cross sectional view along lines 3—3 of FIG. 1.

Referring now to FIGS. 1–3, improved sight rib 10 shown mounted to a gun barrel 20. The improved sight rib is useable only with firearms having barrels provided with one or more top opening slots or vents, designated by the numeral 22 in the figures. Vents 22 provide for gas discharge between bore 3 of the barrel and the atmosphere.

Improved sight rib 10, in the preferred embodiment, includes a housing 11 having an undersurface machined to the curvature of the gun barrel and defining an expansion chamber 25 which is in direct fluid communication with bore 3 of barrel 20 through slots 22. The sight rib is also provided with one or more apertures 15 in the form of bores upwardly extending from and in fluid communication with the expansion chamber. Preferably, there are two rectilinear rows of apertures disposed from one another on opposing sides of the rib. Each pair of oppositely disposed apertures are outwardly diverging from one another at equal angles relative to the longitudinal vertical axial plane of the rib. It is also preferred that the apertures of each pair be backwardly inclined at equal angles relative to the transverse vertical axial plane of the rib, for reasons which will hereinafter be detailed.

Figure 4:
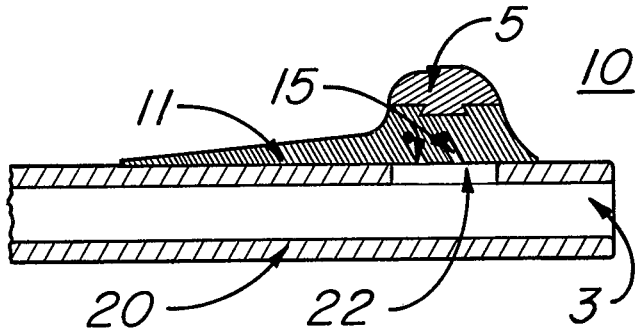
FIG. 4 is a sectional view of a second embodiment of the present invention shown mounted on a gun barrel.

Referring now to FIG. 4, a second embodiment of the improved sight rib of the present invention may be seen. In this embodiment, apertures 15, also in the form of bores, communicate directly with the slots or vents 22 of the barrel and thereby communicate directly with the bore 3 of the barrel. In each embodiment, the improved sight rib is operable to hold sight 5, as with conventional ribs, and in each embodiment the rib is attached to the exterior surface of the barrel by screws 9, by silver solder, or the like. Sight rib, as defined herein and the appended claims hereto, includes a conventional sight rib or, where the conventional rib is omitted, the sight itself.

In operation, an improved sight rib of desired characteristics is first chosen dependent upon the type of firearm, ammunition to be used, and operator's preference. The sight rib may vary as to size; expansion chamber size; and size, location, number, placement, and inclination of apertures 15. With an improved sight rib of proper characteristics, the firearm can, in effect, be fine-tuned as to reaction to recoil. It is to be noted that this "fine-tuning" takes place without a barrel extension and without increasing the number of firearm parts. The improved sight rib is then attached to the exterior top surface of the barrel, as with silver solder, with expansion chamber 25 of the sight rib in fluid communication with bore 3 of the firearm barrel through port 22. Upon firing the firearm, the muzzle tends to jump upwardly because of the upward position of the barrel relative to the stock or handle and the entire firearm is thrust backwardly as the bullet or shot exits the barrel. The upward jump is selectively compensated by the blast trailing the wad or bullet as the blast exits upwardly through slot 22, into expansion chamber 25, and to the atmosphere through the upwardly bored apertures 15. Where apertures 15 are backwardly inclined, the blast exits rearwardly giving a forward thrust to the firearm to selectively compensate for the rearward thrust caused by the exiting bullet or shot. The expansion chamber 25 tends to equalize the pressure of the gases exiting each of the apertures connected therewith to eliminate unbalanced forces which might otherwise deflect the barrel.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An improved sight rib for a firearm having a barrel provided with one or more top opening vents communicating with the bore of the barrel, wherein the improvement comprises:

a sight rib housing;

one or more upwardly extending apertures defined by said housing, each of said apertures in fluid communication with one or more of said vents of said barrel, said apertures operable to vent gases from the bore of said barrel to reduce the recoil of the firearm; and means for attaching said sight rib to the barrel of the firearm.

2. The apparatus as described in claim 1 wherein each of said apertures of said sight rib are rearwardly inclined.

3. The apparatus as described in claim 1 wherein said sight rib includes two or more pairs of said apertures, each aperture of each pair oppositely disposed from one another and diverging from one another at equal angles relative to the longitudinal vertical axial plane of said rib.

4. An improved sight rib for a firearm having a barrel provided with one or more top opening vents communicating with the bore of the barrel, wherein the improvement comprises:

a sight rib housing:

an expansion chamber defined by said housing, said expansion chamber adapted for fluid communication with one or more of said vents of said barrel;

one or more upwardly extending apertures defined by said housing, each of said apertures in fluid communication with said expansion chamber to vent gases from the chamber to reduce recoil of the firearm; and means for attaching said sight rib to the barrel of the firearm.

5. The apparatus as described in claim 4 wherein the sight rib includes one or more pairs of apertures, the apertures of each pair outwardly divergent from one another at equal angles relative to the longitudinal vertical axial plane of said rib.

6. The apparatus as described in claim 5 wherein the apertures of each pair are backwardly inclined at equal angles relative to the transverse vertical axial plane of said rib.

* * * * *